US006663222B2

(12) United States Patent
Verhoest et al.

(10) Patent No.: US 6,663,222 B2
(45) Date of Patent: Dec. 16, 2003

(54) INK JET PRINTER WITH NOZZLE ARRAYS THAT ARE MOVEABLE WITH RESPECT TO EACH OTHER

(75) Inventors: Bart Verhoest, Niel (BE); Dirk De Ruijter, Deurne (BE); Hilbrand Van den Wyngaert, Mortsel (BE); Bart Verlinden, Tongeren (BE)

(73) Assignee: Agfa-Gevaert, Mortsel (BE)

( * ) Notice: Subject to any disclaimer, the term of this patent is extended or adjusted under 35 U.S.C. 154(b) by 46 days.

(21) Appl. No.: 10/022,046

(22) Filed: Dec. 13, 2001

(65) Prior Publication Data

US 2002/0080210 A1 Jun. 27, 2002

Related U.S. Application Data

(60) Provisional application No. 60/264,100, filed on Jan. 25, 2001.

(30) Foreign Application Priority Data

Dec. 22, 2000 (EP) ..... 00204699

(51) Int. Cl.[7] ..... B41J 2/145; B41J 2/15; B41J 2/015; B41J 2/155

(52) U.S. Cl. ..... 347/40; 347/20; 347/42

(58) Field of Search ..... 347/42, 43, 40, 347/20

(56) References Cited

U.S. PATENT DOCUMENTS

| | | | | |
|---|---|---|---|---|
| 4,602,262 A | | 7/1986 | Milligan et al. | 347/130 |
| 4,922,271 A | | 5/1990 | Nilsson et al. | 347/39 |
| 4,999,646 A | | 3/1991 | Trask | 347/41 |
| 5,485,183 A | | 1/1996 | Zandian et al. | 347/41 |
| 5,710,582 A | | 1/1998 | Hawkins et al. | 347/42 |
| 5,719,601 A | | 2/1998 | Moore et al. | 347/9 |
| 5,844,585 A | | 12/1998 | Kurashima et al. | 347/43 |
| 6,124,940 A | | 9/2000 | Heydinger | 358/1.15 |
| 6,183,063 B1 | * | 2/2001 | Bolash et al. | 347/42 |
| 6,234,605 B1 | | 5/2001 | Hilton | 347/42 |
| 6,457,800 B1 | * | 10/2002 | Bohm et al. | 347/19 |

FOREIGN PATENT DOCUMENTS

| | | |
|---|---|---|
| EP | 0 744 706 | 11/1996 |
| EP | 0 791 472 | 8/1997 |
| EP | 0 978 387 | 2/2000 |
| EP | 1 000 757 | 5/2000 |
| JP | 406071947 | 3/1994 |

OTHER PUBLICATIONS

EP 00 20 4699, European Search Report, May 2001.

* cited by examiner

*Primary Examiner*—Thinh Nguyen
(74) *Attorney, Agent, or Firm*—John A. Merecki; Hoffman, Warnick & D'Alessandro

(57) ABSTRACT

An ink jet printer including a first and a second nozzle array, arranged one after another in the printing direction, wherein the second nozzle array is movably arranged in the printer for being displaced so that the number of nozzles in the second nozzle array experience a displacement having a component in a direction orthogonal to the printing direction.

20 Claims, 6 Drawing Sheets

INK JET PRINTER WITH NOZZLE ARRAYS THAT ARE MOVEABLE WITH RESPECT TO EACH OTHER

The application claims the benefit of U.S. Provisional Application No. 60/264,100 filed Jan. 25, 2001.

FIELD OF THE INVENTION

The present invention relates to an ink jet printer, especially to an ink jet printer useful in multimode printing.

BACKGROUND OF THE INVENTION

The requirements for an ink jet printer used for printing images, such as pictures and photographs, and for an ink jet printer used for text reproduction are quite different. In the former case the quality of the print is, provided that a minimum resolution is achieved, more determined by the absence of banding in even density parts and by the number of density levels printable per pixel than by the resolution. In the latter case, the image quality is more determined by the resolution and less by the absence of banding in even density parts and the number of density levels printable per pixel. This means that it is quite difficult to design a single printer that can print pages containing both images—e.g. photographs— and text with high image quality.

In the art of ink jet printing, it is well known how to increase the resolution of a printer. E.g. in U.S. Pat. No. 4,922,271 a matrix printer, a.o. an ink jet printer, is disclosed having multiple printing heads positioned so as to enhance the resolution of the printer beyond the basic resolution of the individual printheads.

Also in U.S. Pat. No. 5,719,601 and U.S. Pat. No. 5,844,585 methods for enhancing the resolution in an ink jet printer beyond the basic resolution of the individual printheads are disclosed.

Also the problem of banding, especially in even density portions of an image, e.g. a picture or photograph, is well known and several measures to avoid this phenomenon have been disclosed; e.g. in U.S. Pat. No. 4,999,646 it is disclosed that by providing complementary and overlying swath patterns of ink jet print, and utilizing super pixeling in the overlying printed areas to generate dot-next-to-dot (DND) printed images, the uniformity and consistency of dot formation over the ink jet printed image could be enhanced. In various documents it is described to solve the problem of banding by printing a single line using more than one nozzle or by printing every dot with more than one nozzle, e.g. by printing half of the density needed with one nozzle and the other half with another nozzle. Also in U.S. Pat. No. 5,844,585 an enhanced form of shingling is disclosed. In U.S. Pat. No. 6,124,940 it is recognized that shingling demands a high data flow from the host computer to the printer—which requires a more expensive printing system—and a method for diminishing the data flow is presented.

U.S. Pat. No. 6,234,605 discloses a liquid ink printer, depositing ink drops to form an image, in multiple printing resolutions, on a recording medium moving along a recording medium path. The liquid ink printer includes a pagewidth printbar, including an array of ink ejecting nozzles spaced at a predetermined resolution, aligned substantially perpendicular to the recording medium path, to eject the ink drops on the recording medium during movement of the recording medium along the recording medium path, a positioning device, coupled to the pagewidth printbar, to position the printbar at a plurality of discrete locations, and a controller, coupled to the printbar and to the positioning device, to cause the positioning device to position the printbar at the plurality of discrete locations as a function of the predetermined resolution.

Although the printers as disclosed in the referenced documents are well suited to have high resolution printing or low banding, there is still a need for a improved printer that can easily be tuned to the needs of the printing job at hand.

SUMMARY OF THE INVENTION

The present invention is an ink jet printer as claimed in the independent claims. Preferred embodiments of the invention are set out in the dependent claims.

FIG. 1 schematically shows an ink jet printer in accordance with the invention. The ink jet printer includes two nozzle arrays 101 and 101', that may be maintained in a frame (not shown). The receiving substrate 103, upon which the image, the text or both are to be printed, is moved along a receiving substrate path in the direction of arrow A, the printing direction. In FIG. 1, the shown portion of the receiving substrate path is rectilinear. In general, the receiving substrate path may have other forms; the receiving substrate may e.g. be guided by a drum, the receiving substrate path may comprise a number of rectilinear portions and a number of curved portions, etc. The first and second nozzle arrays 101, 101' are arranged one after another in the printing direction (i.e. either the receiving substrate first passes nozzle array 101' and then nozzle array 101—as shown in FIG. 1—or it first passes nozzle array 101 and then nozzle array 101'—as shown in FIG. 2). Preferably, the first nozzle array 101 is positioned at a constant first ink-throwing distance from the receiving substrate path. Preferably, the second nozzle array 101' is positioned at a constant second ink-throwing distance from the receiving substrate path, that may be different from the first ink-throwing distance. The first nozzle array 101 has a length L and a number N of nozzles 102 that are positioned in the array with a nozzle pitch NP; the second nozzle array 101' has a length L' and a number N' of nozzles 102' that are positioned in the array with a nozzle pitch NP'. The first nozzle array 101 is positioned so that its length L makes an angle $\alpha$ with the printing direction A, chosen so that $20° \leqq \alpha \leqq 160°$, and the second nozzle array 101' is positioned so that its length L' makes an angle $\alpha'$ with the printing direction A, also chosen so that $20° \leqq \alpha' \leqq 160°$. In the embodiment shown in FIG. 1, the nozzle arrays 101, 101' each have only one row of nozzles. In general, a nozzle array may comprise several rows of nozzles. The "length" L, L' of a nozzle array is determined as the largest distance between the first and the last nozzle of a row of nozzles of the array (e.g. in case of an array consisting of 5 equidistant rows of 1000 equidistant nozzles, wherein the distance between the nozzles is NP and the distance between the rows is also NP, L=(1000−1)*NP).

In the best mode of the invention, angle $\alpha=\alpha'=90°$ and the nozzle arrays 101, 101' are "page wide printhead assemblies". A page wide printhead assembly is defined as follows. The receiving substrate has a width W (not shown in FIG. 1) orthogonal to the printing direction A, and a printable width $W_P$ (not shown in FIG. 1) that may be smaller than W in case there is at least one unprinted border. In a page wide printhead assembly, the number of nozzles N and the length L are so large that the printable width $W_P$ is covered, eliminating the need to shuttle the printhead assembly as is the case in shuttle printers. In a so-called shuttle printer, a printhead assembly has a length L that is substantially smaller than the printable width $W_P$ of the receiving substrate (or, in case the printhead assembly is at an angle $\alpha$ to the printing direction A that is different from 90°, L*sin $\alpha$ is substantially smaller than $W_P$), so that the printhead has to scan the receiving substrate, i.e. to reciprocate, in order to cover the printable width $W_P$.

A page wide printhead assembly can be obtained in different ways, e.g. by means of a single, "monolithic" printhead, by means of a number of staggered printheads, etc.

In an ink jet printer according to the invention, the second nozzle array 101' is arranged so as to be movable back and forth as indicated by arrow M. When moving the second nozzle array along the direction indicated by arrow M, the nozzles experience a displacement that has a non-zero component in a direction M' orthogonal to the printing direction A and a component (that is zero if $\alpha$=90°) in a direction M" parallel to the printing direction; this allows to change the mode, e.g. text or image mode, of the printer.

A first advantage of an ink jet printer in accordance with the invention is the availability of multimode printing: the user has the possibility to switch the printer in an easy way between two or, which is preferred, three of the following modes: pure image mode, pure text mode and mixed text/image mode.

Another advantage of the invention is that the amount of data that has to be sent to the printer may be minimized for each printing mode.

Yet another advantage is that the change-over from mode to mode can proceed during printing, i.e. without stopping the printer.

Further advantages and embodiments of the present invention will become apparent from the following description and drawings.

BRIEF DESCRIPTION OF THE DRAWINGS

The invention is described with reference to the following drawings without the intention to limit the invention thereto, and in which.

DETAILED DESCRIPTION OF THE INVENTION

Figure 1:
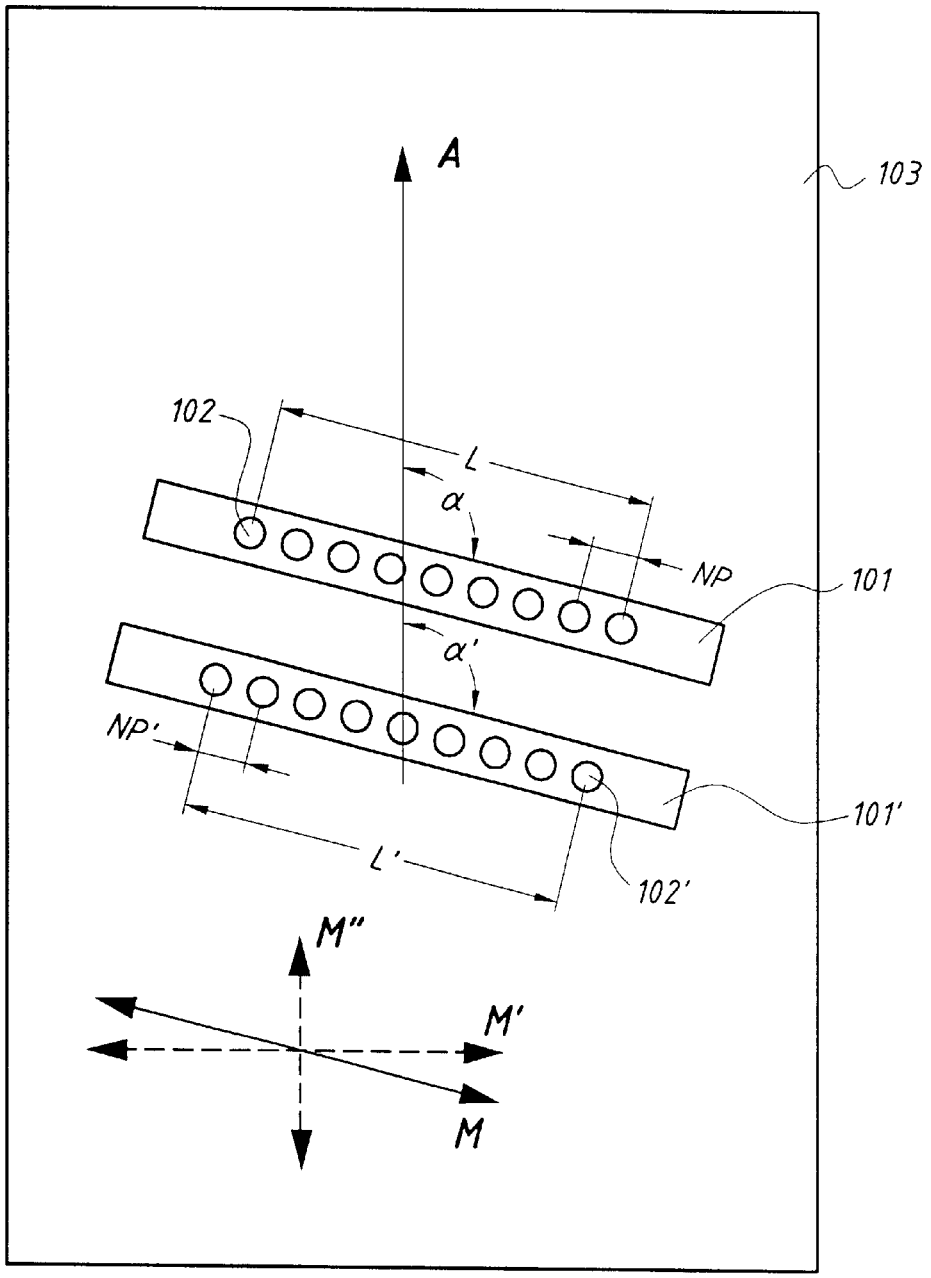
FIG. 1 schematically shows a printer according to this invention.

FIG. 1 schematically shows a printer according to the invention, as discussed already above. In a preferred embodiment, the second nozzle array 101' is movably arranged in the printer for being displaced in the direction M' over a distance that equals at least (sin $\alpha$'.NP')/2, which corresponds to a distance of at least NP'/2 in the direction of arrow M. This makes it possible, by using two nozzle arrays 101, 101', to double the resolution that can be attained with a single nozzle array 101, as will also be clarified below.

In a further preferred embodiment, the angle $\alpha$ equals the angle $\alpha$'. Preferably, in a printer according to the invention, L=L', N=N' and NP=NP'. It is preferred that both the angles $\alpha$ and $\alpha$' are chosen so that $75° \leqq \alpha \leqq 105°$ and $75° \leqq \alpha' \leqq 105°$. In a most preferred embodiment of the invention, $\alpha=\alpha'=90°$, L=L', N=N' and NP=NP'.

In a further embodiment, the nozzle arrays are stationary with respect to the printing direction A.

In a further preferred embodiment, said first and second nozzle array are equipped to eject ink with substantially equal chromaticity. Chromaticity describes objectively hue and saturation of a color, and may be measured in terms of CIE x,y or u',v' (of. "The reproduction of color in photography, printing & television" by R. W. G. Hunt, 4th edition 1987, ISBN 0 86343 088 0, pp. 71–72). The term "substantially equal" means that, as expressed in the approximately uniform CIE L*a*b* color space, the following holds:

$$\sqrt{(\Delta a^*)^2+(\Delta b^*)^2} \leqq \text{delta}$$

wherein delta=20, preferably delta=10, more preferably delta=5.

Figure 2:
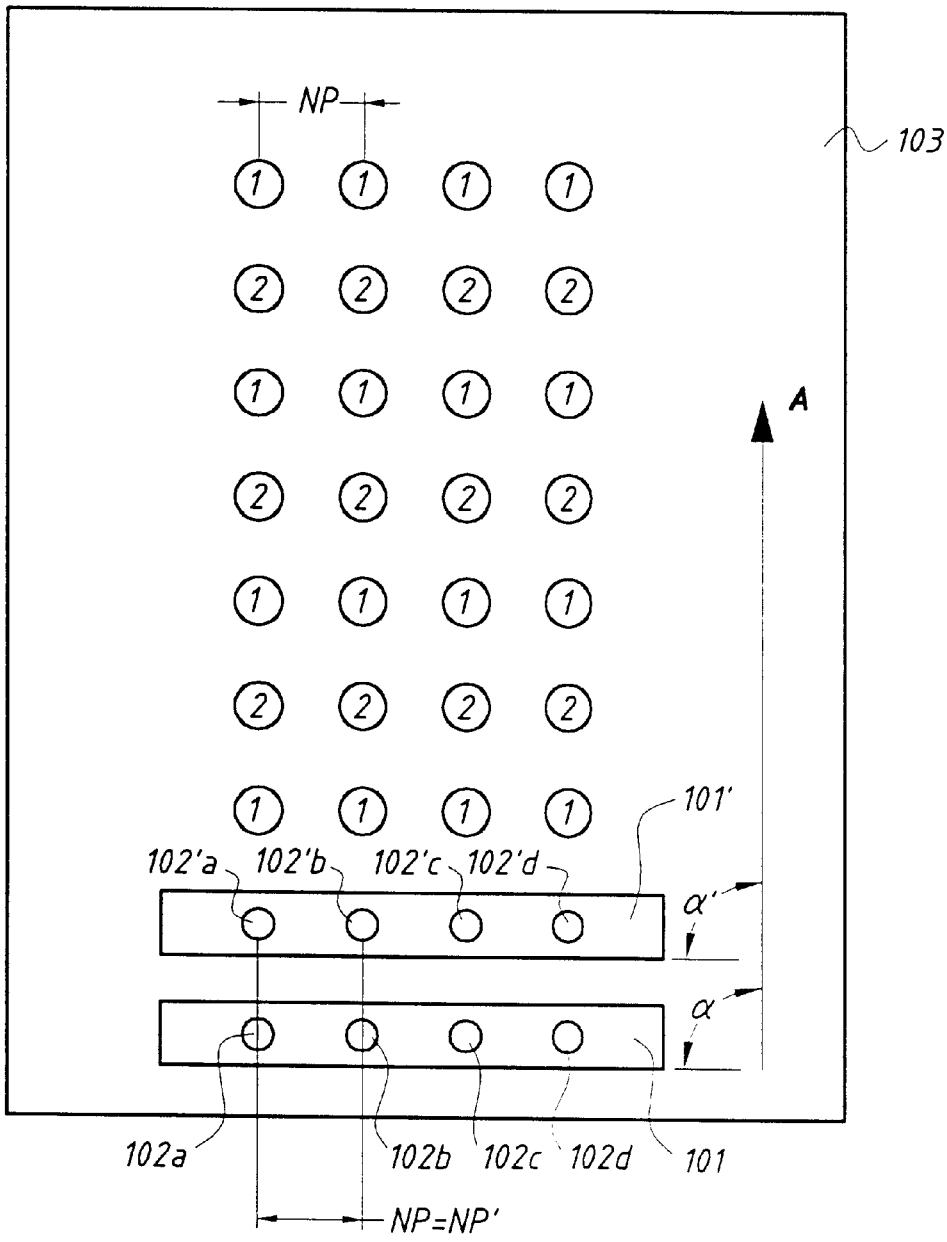
FIG. 2 schematically shows the operation of a printer according to this invention in "image mode" with shingling in one direction.

A printer according to this invention can be used in "image mode", with shingling in the printing direction. This is schematically shown in FIG. 2. In this figure, the number N and N' of dots in each array is restricted to 4 for sake of clarity, the nozzle pitch NP=NP'=70 $\mu$m i.e. 360 dpi. The angles $\alpha$ and $\alpha$' are both equal to 90°. The receiving substrate travels under the nozzle arrays at a speed so as to achieve a resolution, in the printing direction A, equal to the nozzle pitch of the arrays of apertures. Both nozzle arrays are equipped for ejecting ink with substantially equal chromaticity. The first nozzle array 101 having a plurality of nozzles 102*a*, 102*b*, 102*c*, 102*d*, is placed so that each of the nozzles is positioned to correspond to a desired, different, print location, the second nozzle array 101' having a plurality of nozzles 102'*a*, 102'*b*, 102'*c*, 102'*d*, is movably arranged (in the direction of arrow M) and for "image mode" printing placed so that the print location of each of the nozzles of the second array corresponds to one of the print locations of the first array such that the first and second arrays each have one nozzle corresponding to each desired print location. The dots printed by the nozzles of the first array are indicated by the number 1 and the dots printed by the second array by the number 2. The arrays of nozzles are addressed so that the first row of dots is printed by the nozzles 102*a*, 102*b*, 102*c*and 102*d*. The second row is printed by nozzles 102'*a*, 102'*b*, 102'*c* and 102'*d*, the third row is printed by the nozzles 102*a*, 102*b*, 102*c* and 102*d*, and so on. By doing so dots adjacent in the columns of the image are printed with a different nozzle and thus is shingling in the columns of the image (parallel to the printing direction) achieved and banding diminished. When both nozzle arrays are positioned as shown in FIG. 2, the second of the nozzle arrays can be used as redundant array. In this case the second nozzle array is used to print only when the corresponding nozzle of the first nozzle array does not print (i.e. is defective). E.g. when nozzle 102*b* of the first array is defective, then nozzle 102'*b* is used to print.

Figure 3:
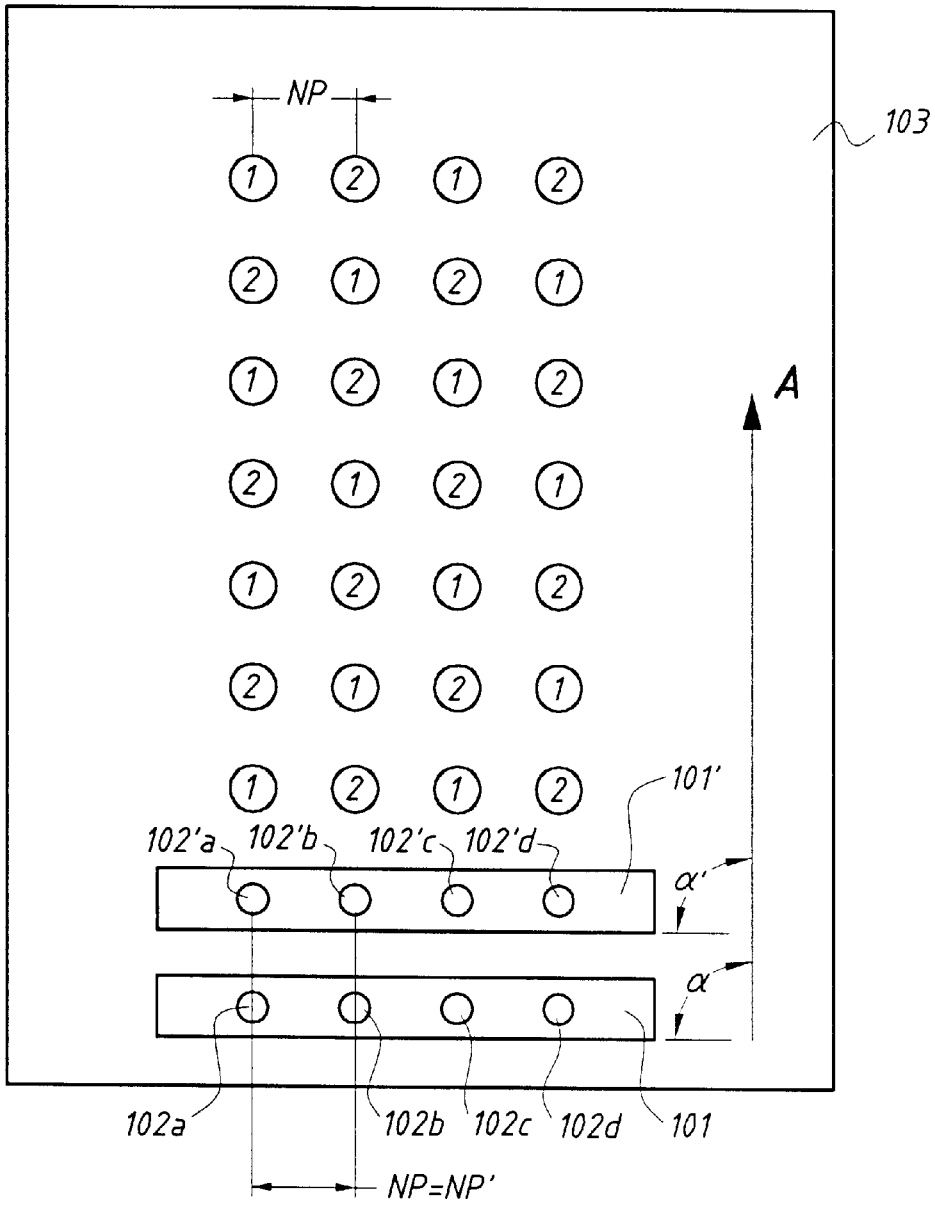
FIG. 3 schematically shows the operation of a printer according to this invention in "image mode" with shingling in two directions.

In FIG. 3, a printer according to this invention used in "image mode" and addressed to achieve shingling both in the columns and the rows of the image is shown. The printer schematically shown in FIG. 3 is basically the same as the one schematically shown in FIG. 2, only the way of addressing the various nozzles is changed.

The arrays of nozzles are addressed so that the first row of dots is printed by the nozzles 102*a*, 102'*b*, 102*c* and 102'*d*. The second row is printed by nozzles 102'*a*, 102*b*, 102'*c* and

102*d*, the third row is printed by the nozzles 102*a*, 102'*b*, 102*c* and 102'*d*, and so on. The result is that in every row and column the dots are printed by the alternation between the two nozzle arrays so that shingling is achieved in the columns (parallel to the printing direction): the adjacent dots are printed with different nozzles and banding is diminished. In the rows of dots (orthogonal to the printing direction) interlacing is achieved.

Figure 4:
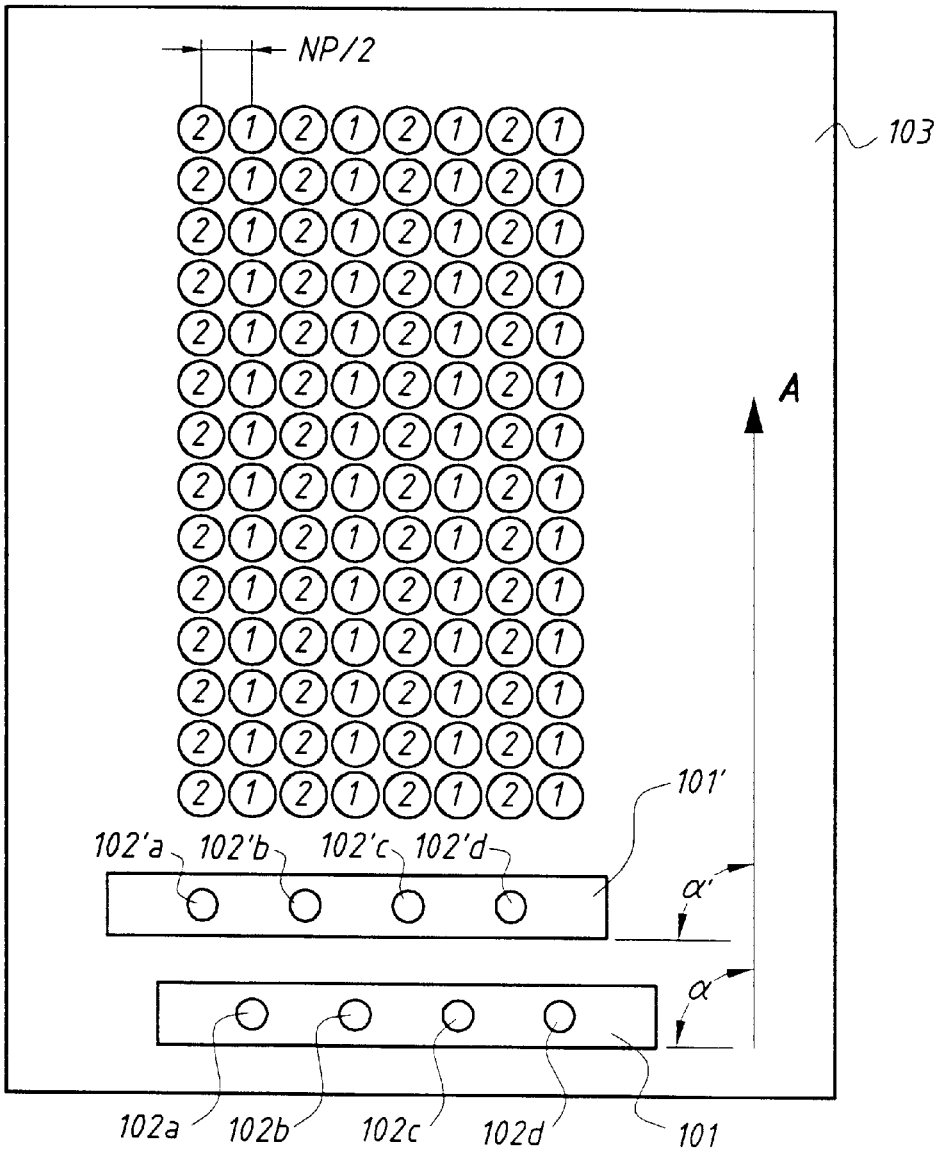
FIG. 4 schematically shows the operation of a printer according to this invention in "text mode"

In FIG. 4, the printer as schematically shown in FIG. 2, is used in "text mode". The second array 101' is moved over a distance equal to (sin α'.NP')/2, which is with α'=90° over half the nozzle pitch so that the nozzles of the second array are placed for printing, in a row of dots, dots between the dots printed by the nozzles of the first array, thus the resolution is doubled and with a printer having printheads with a "native" resolution of 360 dpi a resolution of 720 dpi is realized. The result is that in every row of dots the alternate dots are still printed by a different nozzle so that interlacing is still achieved in that direction, but every dot in a column of dots is printed with a single nozzle, in FIG. 4: the outermost left column is printed by nozzle 102'*a*, the following column by nozzle 102*a*, the next column by nozzle 102'*b*, and so on. Thus no shingling is achieved.

The movement of the second nozzle array can proceed by any means known in the art, e.g., a stepping motor. When both the first and second nozzle array have a "native" resolution of 360 dpi, then the nozzle pitch is 70 μm, thus when the second array is displaced, it is displaced over 35 μm. This can proceed very accurately using stepping motors that have steps in the micrometer range (steps of 2 to 5 μm). To enhance the reproducibility of the displacement, dampening springs can be used.

One of the advantages of a printer construction according to this invention is the simplicity and the possibility to easily change the physical resolution of the printer, e.g. by providing a button on the control panel of the printer for switching between "image mode", "text mode" or "mixed text/image mode", without need to have special image processing and thus the need to send an excessive amount of data to the printer. Another advantage of this printer is the ease with which the printing speed and image quality can be exchanged: e.g. in the printing mode shown in FIG. 2 the printing speed is high but the image has only shingling, whereas in the printing mode shown in FIG. 3 the printing speed is lower (since it is limited by the maximum nozzle firing rate) but the image has shingling and interlacing. This means that the printer gives the user more freedom to adapt the performance of the printer to the requirements of the job at hand than in other printers.

Another advantage of the concept of constructing an ink jet printer with a physically movable nozzle array is the versatility of the concept.

It can be used to manufacture a single pass monochrome printer having three possible printing modes, pure "image mode", pure "text mode" and "mixed text/image mode". When introducing four nozzle arrays, paired two by two with in each pair one movable array, it is possible to have both pairs of the nozzle arrays in "image mode" and thus having a high speed image printing with shingling, it is possible to have both pairs in "text mode" and thus having a high speed text printing without shingling, and it is possible to operate the printer in "mixed text/image mode" when images and text have to be printed. In that case one of the pairs of nozzle arrays is placed in "image mode" and the other one in "text mode" so that both text portions and image portions can be printed in a single pass with adapted quality, i.e. image portions wherein a minimum resolution is achieved and more emphasis is placed on the absence of banding in even density parts and the number of density levels printable per pixel and text portions with high resolution and less emphasis on by the absence of banding in even density parts and by the number of density levels printable per pixel.

The concept of constructing an ink jet printer with a physically movable nozzle array, as per this invention, can be used to manufacture a single pass multicolor printer. When introducing 5 pairs of nozzle arrays with in each pair one movable array, e.g. one pair designed for printing Y (yellow), one pair designed for printing M (magenta), one pair designed for printing C (cyan), and two pairs designed for printing K (black) it is possible to have an "image mode" printing with shingling using the YMC pairs of nozzle arrays and one of the pairs of nozzle arrays designed for printing K, in the way as schematically shown in FIG. 2 for 1 pair of nozzle arrays. It is also possible with such a printer to switch one or more of the pairs of nozzle arrays—depending on the color of the text to be printed—in "text mode" in the way as schematically shown in FIG. 4 for 1 pair of nozzle arrays. The printer can also be switched in "mixed text/image mode" when the YMC pairs of nozzle arrays and one of the pairs of nozzle arrays designed for printing K are switched to "image mode" and one of the nozzle arrays designed for printing K (black) to "text mode".

In a further embodiment of an ink jet printer according to this invention, not only said second nozzle array 101' is movably arranged, but also said first nozzle array 101 is movably arranged in said printer for being displaced so that said number N of nozzles experience a displacement that has a non-zero component in the direction M' orthogonal to the printing direction A. The displacement of the N nozzles 102 of the first nozzle array may be different from the displacement of the N' nozzles 102' of the second array, and the components in the direction M' may also be different from each other. In such a printer, as discussed above, it is preferred that L=L', N=N', NP=NP' and α=α'. It is then preferred that the second nozzle array 101' is movably arranged in said printer for being displaced in the direction M' over a distance that equals at least (sin α'.NP')/2, whereas the first nozzle array 101 is movably arranged in the printer for being displaced in the direction M' over a distance that equals at least (sin α.NP)/2. When in a very preferred embodiment α=α'=90°, both arrays of nozzles are movably arranged for being displaced over a distance of at least half the nozzle pitch, and preferably over a distance equal to half the nozzle pitch.

Figure 5A:
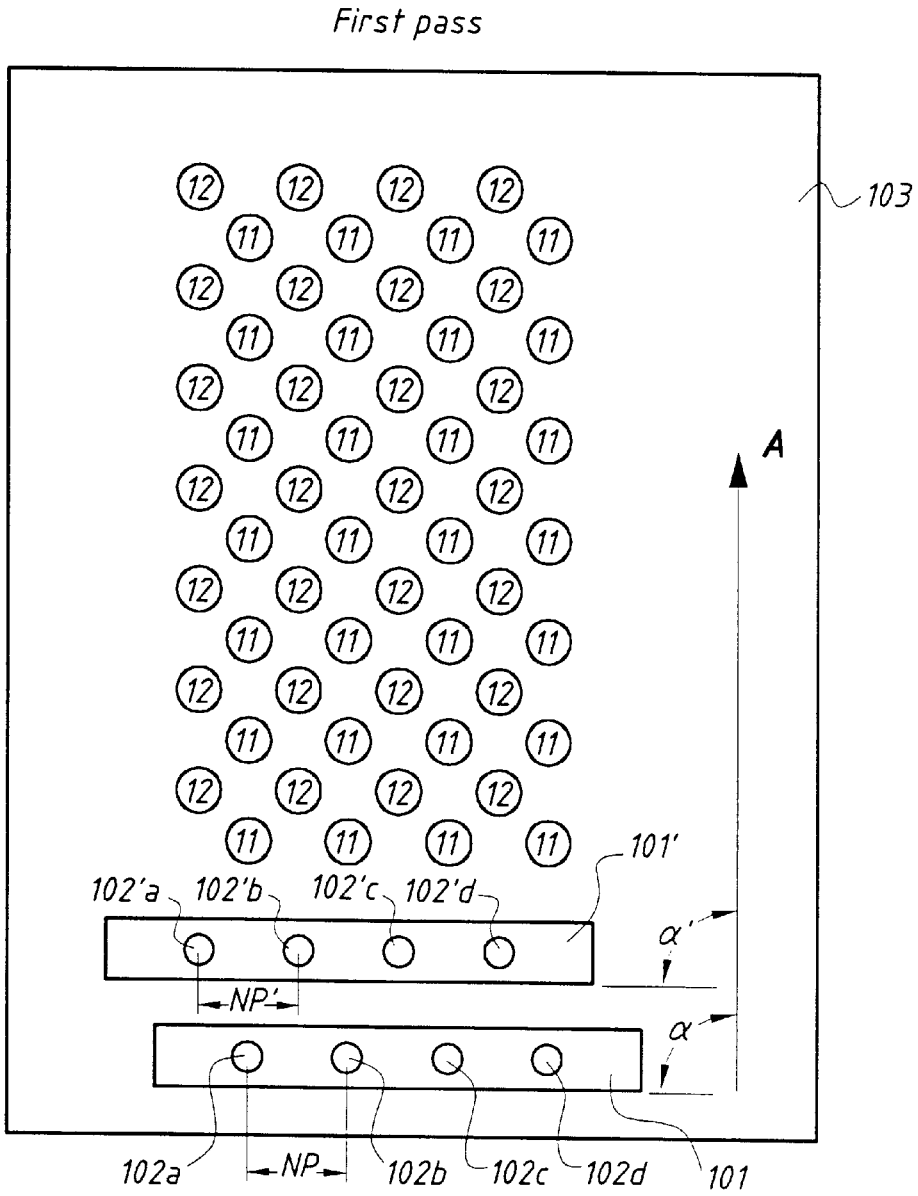
FIGS. 5*a* and 5*b* schematically show the operation of a printer according to this invention wherein shingling and high resolution are combined.
Figure 5B:
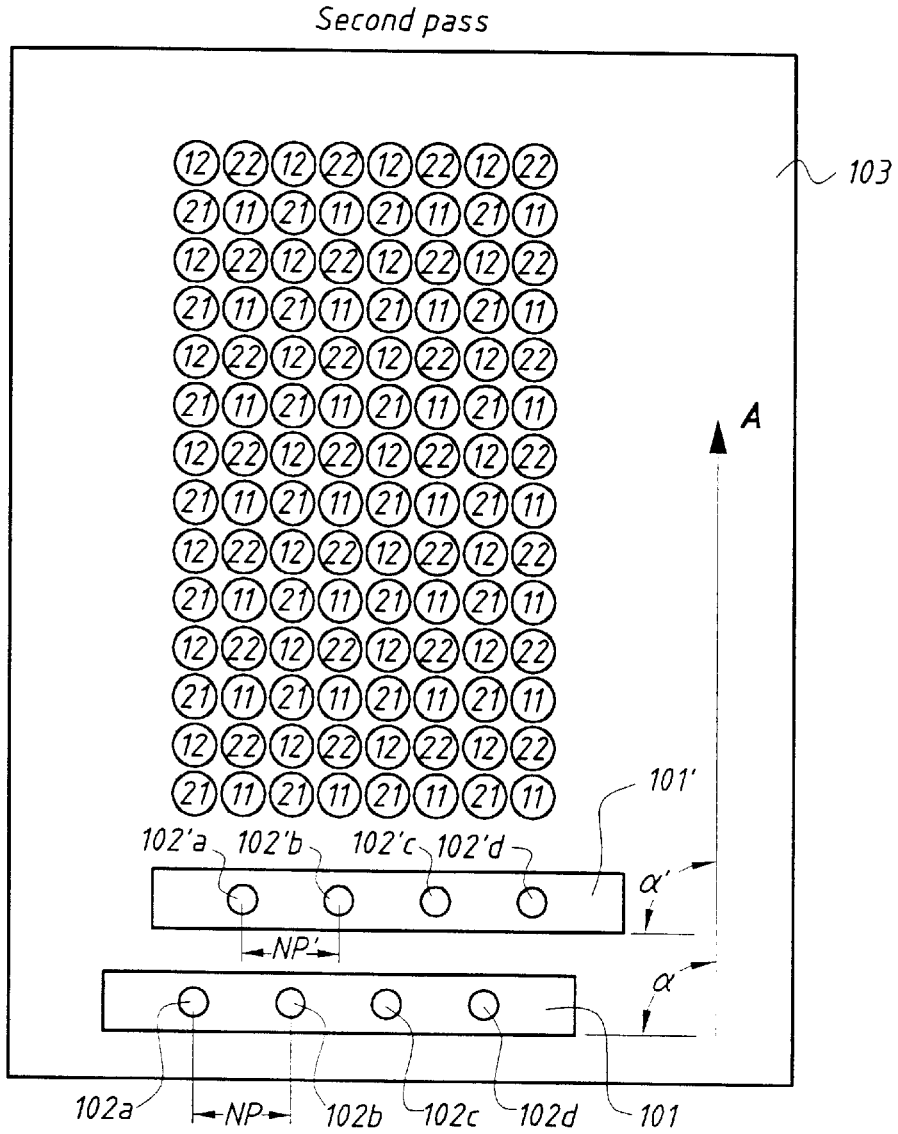

With such a printer it is not only possible to the print with shingling and somewhat lower resolution or to print with high resolution without shingling as described in FIGS. 2 and 3 and above, but it is possible to combine shingling with the high resolution, when the possibility to switch the printer from a single to a double pass printer is present in the printer. This possibility is shown in FIGS. 5*a* and 5*b*. In FIG. 5*a*, the first pass in the printer is shown. In this figure, the number N and N' of dots in each array is restricted to 4 for sake of clarity, the nozzle pitch NP=NP'=70 μm i.e. 360 dpi. The angles α and α' both are equal to 90°. The receiving substrate travels under the nozzle arrays at a speed so as to achieve a resolution, in the printing direction A, equal to half to the nozzle pitch of the arrays of apertures. The dots printed through the nozzles 102*a*, 102*b*, 102*c*, 102*d* of the first nozzle array 101 during the first pass are indicated by 11 and he dots printed through the nozzles 102' *a*, 102'*b*, 102'*c*, 102'*d* of the second nozzle array 101' during the first pass are indicated by 12. Both nozzle arrays are placed at an angle $\alpha=\alpha'=90°$ with respect to the printing direction A. The second nozzle array 101' is moved—in the figure to the left—over half the nozzle pitch so that the nozzles of the second array are placed between nozzles of the first array. During the first pass the receiving substrate travels at a speed so as to have rows of dots printed at intervals equal to half the nozzle pitch. During that pass a first row of dots is printed by the first nozzle array, a second row of dots is printed by the second nozzle array, the third row of dots is printed again by the first nozzle array, the fourth row of dots is printed by the second nozzle array and so on. The rows of dots are shifted with respect to each other over half the nozzle pitch, NP=NP'.

In FIG. 5*b*, the second pass in the printer is shown. The second nozzle array 101' is shifted half a nozzle pitch back to the right and the first nozzle array 101 is shifted half a nozzle pitch to the left. The dots printed by the first nozzle array during the second pass are indicated by 21, and the dots printed by the second nozzle array during the second pass are indicated by 22. Again a first row of dots is printed by the first nozzle array, a second row of dots is printed by the second nozzle array, the third row of dots is printed again by the first nozzle array, the fourth row of dots is printed by the second nozzle array and so on. Because of the shift of the nozzle arrays during the second pass, the first row of dots is printed by the nozzles 102*a*, 102*a*, 102*b*, 102*b*, 102*c*, 102*c*, 102*d* and 102*d*; the second row is printed by nozzles 102'*a*, 102'*a*, 102'*b*, 102'*b*, 102'*c*, 102'*c*, 102'*d* and 102'*d*; the third row is printed by the nozzles 102*a*, 102*a*, 102*b*, 102*b*, 102*c*, 102*c*, 102*d* and 102*d*; and so on. The result is that in every column the dots are printed by the alternation between the two nozzle arrays so that shingling is achieved: the adjacent dots are printed with different nozzles and banding is diminished.

Depending on the number of pairs of nozzle arrays and the provided colors, a ink jet printer in accordance with the invention can operate as a monochrome single pass printer, as a monochrome double pass printer, as a multicolor single pass printer, as a multicolor double pass printer. If, in a pair of nozzle arrays, both arrays are movably arranged in the printer, and if enough pairs of nozzle arrays and colors are provided, the printer can be switched between single pass monochrome "image mode", single pass monochrome "text mode", single pass monochrome "mixed mode", single pass multicolor "image mode", single pass multicolor "text mode", single pass multicolor "mixed mode", double pass monochrome "image mode", double pass monochrome "text mode", double pass monochrome "mixed mode", double pass multicolor "image mode", double pass multicolor "text mode", double pass multicolor "mixed mode".

In a particular embodiment of the invention, the first and second nozzle arrays of a pair of nozzle arrays are both incorporated in a single printhead assembly, preferably in a single page wide printhead assembly. As discussed above, the first or the second or both nozzle arrays are movably arranged in the printer. An advantage of this particular embodiment is that cleaning is simplified, e.g. in case two nozzle arrays are used for printing a specific color, and these two nozzle arrays are incorporated in a single printhead.

Those skilled in the art will appreciate that numerous modifications and variations may be made to the embodiments disclosed above without departing from the scope of the present invention as defined in the appending claims.

What is claimed is:

1. An ink jet printer having a printing direction, the printer comprising:

a first nozzle array having a length L and a number N of nozzles, positioned so that said length L makes an angle $\alpha$ with said printing direction wherein $20° \leqq \alpha \leqq 160°$;

a second nozzle array having a length L' and a number N' of nozzles, positioned so that said length L' makes an angle $\alpha'$ with said printing direction wherein $20° \leqq \alpha \leqq 160°$;

wherein said first and said second nozzle arrays are arranged one after another in said printing direction; and wherein said second nozzle array is movably arranged in said printer for being displaced so that said number N' of nozzles experience a linear displacement having an equal displacement component in a direction orthogonal to said printing direction.

2. The ink jet printer according to claim 1 wherein said first and second nozzle arrays are incorporated in a single printhead assembly.

3. The ink jet printer according to claim 1 wherein said second nozzle array has a nozzle pitch NP' and wherein said component in said direction orthogonal to said printing direction has a magnitude of at least $(\sin \alpha'.NP')/2$.

4. The ink jet printer according to claim 3 wherein said first nozzle array is movably arranged in said printer for being displaced so that said number N of nozzles experience a first displacement having a first component in said direction orthogonal to said printing direction.

5. The ink jet printer according to claim 4 wherein said first nozzle array has a nozzle pitch NP and wherein said first component in said direction orthogonal to said printing direction has a magnitude of at least $(\sin \alpha.NP)/2$.

6. The ink jet printer according to claim 5 wherein NP=NP'.

7. The ink jet printer according to claim 1 wherein N=N', L=L' and $\alpha=\alpha'$.

8. The ink jet printer according to claim 7 wherein $\alpha=\alpha'=90°$.

9. The ink jet printer according to claim 1 wherein said first and second nozzle arrays are equipped to elect ink having a substantially equal chromaticity.

10. An ink jet printer having a printing direction, the printer comprising:

a first page wide printhead assembly having a length L and a number N of nozzles, positioned so that said length L makes an angle $\alpha$ with said printing direction, wherein $20° \leqq \alpha \leqq 160°$;

a second page wide printhead assembly having a length L' and a number N' of nozzles, positioned so that said length L' makes an angle $\alpha'$ with said printing direction, wherein $20° \leqq \alpha \leqq 160°$;

wherein said first and said second page wide printhead assemblies are arranged one after another in said printing direction; and wherein said second page wide printhead assembly is movably arranged in said printer for being displaced so that said number N' of nozzles experience a linear displacement having a an equal displacement component in a direction orthogonal to said printing direction.

11. The ink jet printer according claim 10 wherein said first and second page wide printhead assemblies are incorporated in a single printhead assembly.

12. The ink jet printer according to claim 10 wherein said second page wide printhead assembly has a nozzle pitch NP' and wherein said component in said direction orthogonal to said printing direction has a magnitude of at least $(\sin \alpha'.NP')/2$.

13. The ink jet printer according to claim 12 wherein said first page wide printhead assembly is movably arranged in said printer for being displaced so that said number N of nozzles experience a first displacement having a first component in said direction orthogonal to said printing direction.

14. The ink jet printer according to claim 13 wherein said first page wide printhead assembly has a nozzle pitch NP and wherein said first component in said direction orthogonal to said printing direction has a magnitude of at least (sin $\alpha$.NP)/2.

15. The ink jet printer according to claim 14 wherein NP=NP'.

16. The ink jet printer according to claim 10 wherein N=N', L=L' and $\alpha=\alpha'$.

17. The ink jet printer according to claim 10 wherein said first and second page wide printhead assemblies are equipped to eject ink having a substantially equal chromaticity.

18. An ink jet printer for printing on a receiving substrate moving along a receiving substrate path in a printing direction, the printer comprising:

a first page wide printhead assembly having a first length and a first nozzle pitch, wherein said first page wide printhead assembly is positioned at a first ink-throwing distance from said receiving substrate path and with said first length along a first direction orthogonal to said printing direction;

a second page wide printhead assembly having a second length equal to said first length and a second nozzle pitch equal to said first nozzle pitch, wherein said second page wide printhead assembly is positioned at a second ink-throwing distance from said receiving substrate path and with said second length along said first direction orthogonal to said printing direction;

wherein said first page wide printhead assembly is movably arranged in said printer for being displaced along said first direction orthogonal to said printing direction over a first distance of at least half of said first nozzle pitch; and wherein said second page wide printhead assembly is movably arranged in said printer for being displaced along said first direction orthogonal to said printing direction over a second distance of at least half of said first nozzle pitch.

19. The ink jet printer according claim 18 wherein said first and second page wide printhead assemblies are incorporated in a single printhead assembly.

20. The ink jet printer according to claim 18 wherein said first and second page wide printhead assemblies are equipped to eject ink having a substantially equal chromaticity.

* * * * *